United States Patent [19]

DeVittorio

[11] 4,090,348

[45] May 23, 1978

[54] SPINNING OR TWISTING MACHINE RING DRIVE

[75] Inventor: Joseph M. DeVittorio, Carmel, Ind.

[73] Assignee: Spintex, Inc., Indianapolis, Ind.

[21] Appl. No.: 706,569

[22] Filed: Jul. 19, 1976

[51] Int. Cl.[2] ..... D01H 1/241; D01H 7/58

[52] U.S. Cl. ..... 57/105; 57/124; 74/226

[58] Field of Search ..... 57/104–105, 57/124, 137; 74/221, 226

[56] References Cited

U.S. PATENT DOCUMENTS

| | | | |
|---|---|---|---|
| 865,685 | 9/1907 | Dawes | 57/124 X |
| 1,473,820 | 11/1923 | Laroche et al. | 57/105 |
| 1,665,422 | 4/1928 | Setzer | 57/105 |
| 2,541,238 | 2/1951 | Goree | 57/124 |
| 2,921,430 | 1/1960 | Scrogg et al. | 57/104 X |
| 3,025,657 | 3/1962 | Noordenbos | 57/124 X |
| 3,364,764 | 1/1968 | Fiddes | 74/221 |
| 3,461,660 | 8/1969 | Nimtz et al. | 57/105 |

FOREIGN PATENT DOCUMENTS

| | | | |
|---|---|---|---|
| 1,014,031 | 12/1965 | United Kingdom | 57/124 |

*Primary Examiner*—Richard C. Queisser
*Assistant Examiner*—Charles Gorenstein

[57] ABSTRACT

In a spinning or twisting machine in which the ring positioned about each spindle and bobbin is carried rotatably by the ring rail. A traveler is carried by each ring. A wheel is located next to each ring. An endless drive belt extends between each ring and wheel. Each wheel is shiftable so as to move the drive belt from a location spaced from the adjacent ring into contact with the ring to cause the ring to be driven rotatably about the spindle and bobbin.

6 Claims, 7 Drawing Figures

SPINNING OR TWISTING MACHINE RING DRIVE

SUMMARY OF THE INVENTION

This invention relates to an improved ring drive for a spinning or twisting machine.

In this invention a series of rings are mounted rotatably upon a ring rail with each ring being positioned about a spindle carrying a bobbin. A traveler is carried by each ring for movement relative to the ring in directing filament material onto the rotating bobbin. A wheel also carried by the ring rail is positioned next to each ring. An endless drive belt passes between each wheel and its associated ring. Means are provided for shifting each wheel toward its associated ring to cause the drive belt extending therebetween to be flexed into contact with the ring and the ring to be rotated. When it is desired to stop a selected ring, such as in an ends down situation, the wheel associated with the ring is shifted to allow the drive belt to flex into a spaced relationship from the ring.

By designing the ring drive so that one endless belt can accommodate a set of rings mounted upon a ring rail, the rings including the ring rail and drive belt can be mounted to the frame of the spinning or twisting machine in modular sections. Such modular sections can be installed simply and rapidly, thereby reducing down time for the spinning or twisting machine, as well as facilitating repair and maintenance of the machine. Additionally, by utilizing modular sections of ring drives, the capacity of the machine can be varied to accommodate a particular size job order.

Accordingly, it is an object of this invention to provide a ring drive which is for a spinning or twisting machine and which is of reliable operation.

Another object of this invention is to provide a ring drive which is for a spinning or twisting machine and which is operable independently of the spindle drive for the machine.

Still another object of this invention is to provide a ring drive which is for a spinning or twisting machine and which is of economical construction.

Still another object of this invention is to provide a drive forming a part of a spinning or twisting machine which rotates the rings thereof at speeds in excess of 5000 r.p.m.'s.

And still another object of this invention is to provide a ring drive for a spinning or twisting machine which decreases the time required to wind a given amount of material onto a spindle.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

Figure 1:
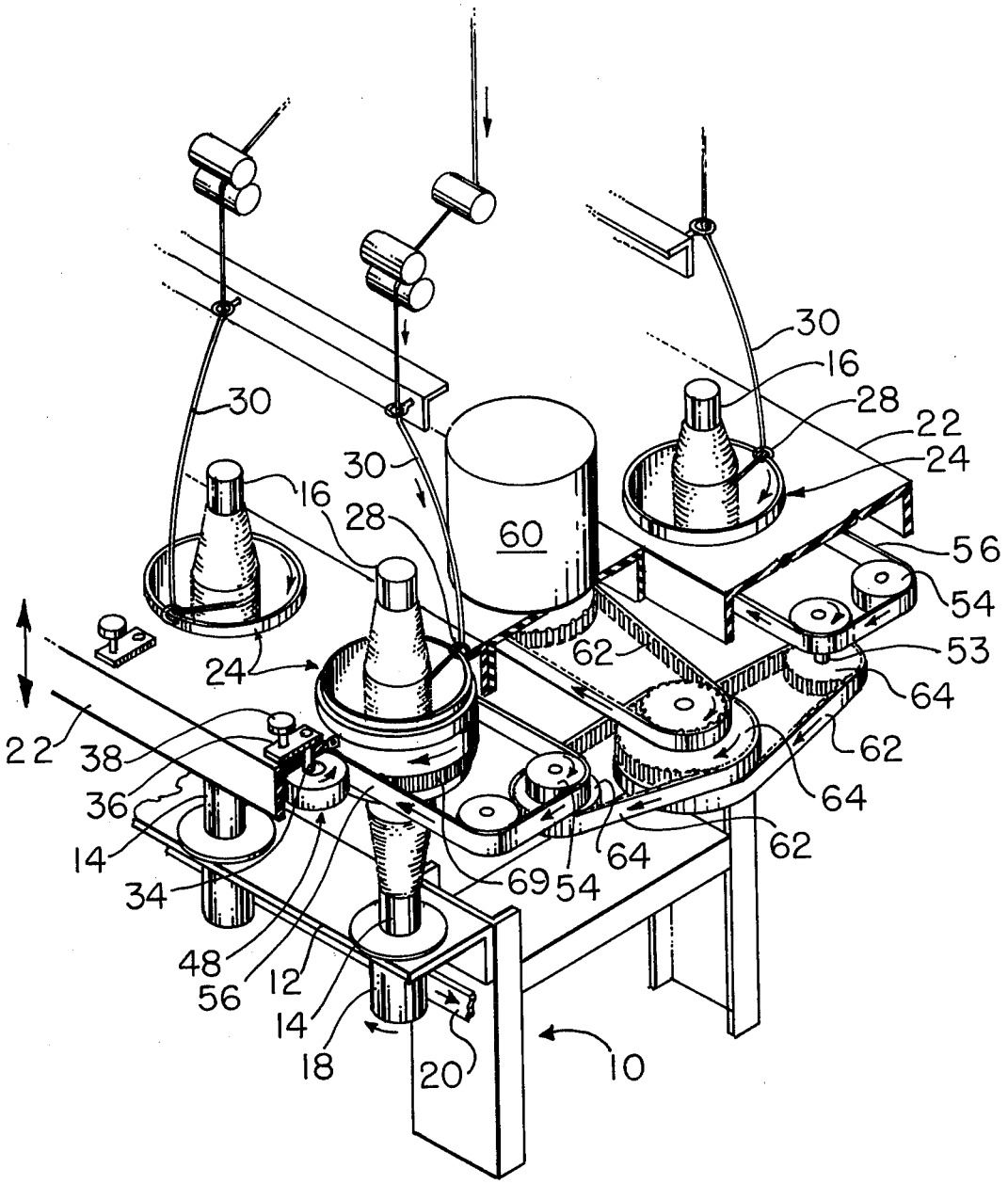
FIG. 1 is a perspective view of a fragmentary portion of a spinning or twisting machine showing the ring drive of this invention with parts of the machine being broken away for purposes of illustration.
Figure 2:
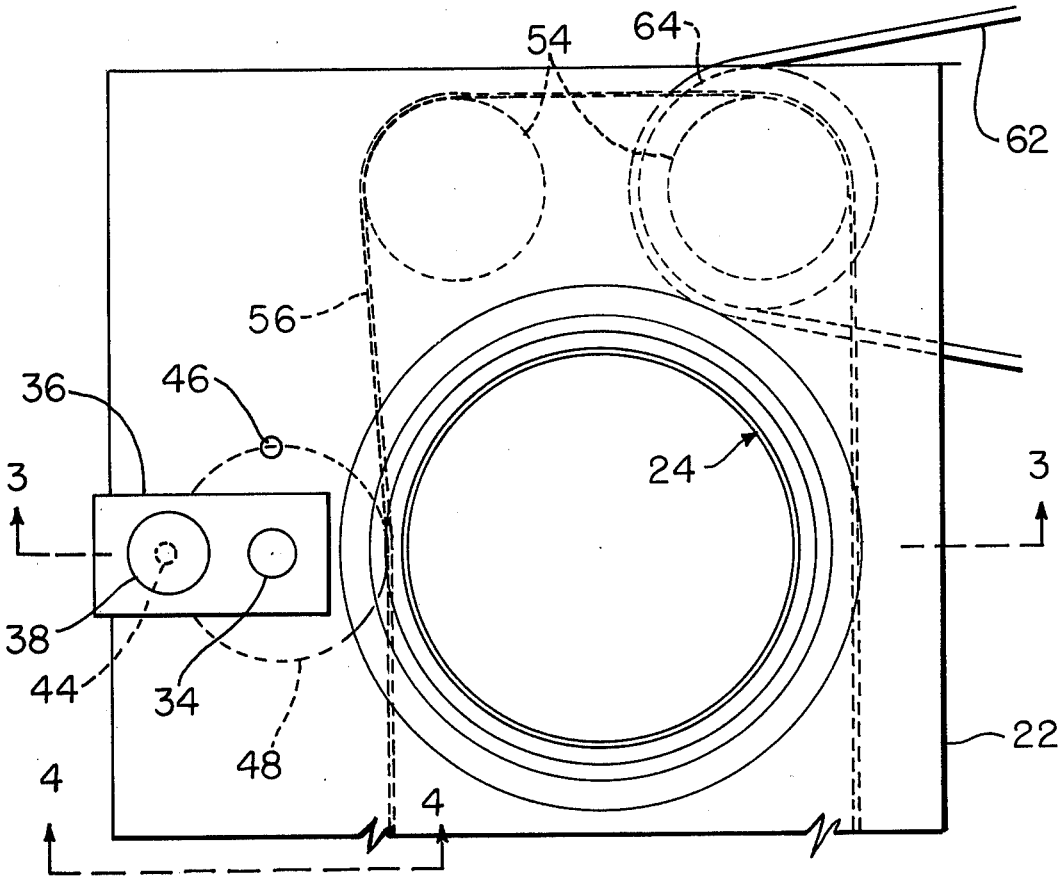
FIG. 2 is a plan view of one ring drive shown in its engaged mode.
Figure 3:
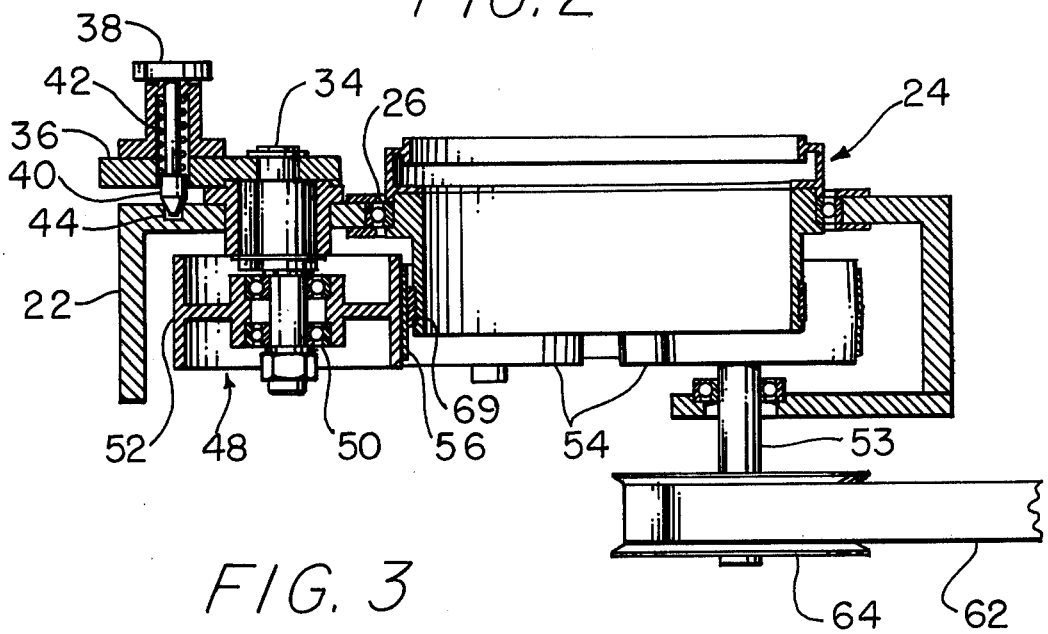
FIG. 3 is a sectional view taken along line 3—3 of FIG. 2.

The spinning or twisting machine depicted in fragmentary form in FIG. 1 includes a frame 10 which carries a parallel set of spindle rails (only one shown). Each spindle rail 12 rotatably supports a plurality of spindles 14. A bobbin 16 is connected to each spindle 14 for rotation with the spindle. Each spindle 14 includes a wharve 18 which contacts a drive belt 20 for imparting rotation to the spindle and its bobbin 16. A ring rail 22 is positioned above each spindle rail 12 and is suitably connected to machine frame 10 for reciprocating vertical movement. A plurality of openings are formed in each ring rail 22 to accommodate the upwardly protruding spindles 14 and bobbins 16. Positioned about each spindle 14 and its associated bobbin 16 is a ring 24. Each ring 24 is carried within a spindle-accommodating opening in the ring rail and is supported by the ring rail for rotation by a bearing member 26. A traveler 28 is carried by each ring 24. Each traveler 28 slides about the lipped periphery of its accommodating ring 24.

Filament material 30, which may be any of a variety of materials, such as silk, cotton, wool or fiberglass, is fed through each traveler 28 and onto the adjacent rotating bobbin 16. Each ring 24 is caused to rotate in the direction of rotation of its associated spindle 14 at a selected independent speed which is less than the speed of rotation of the spindle. This rotation of rings 24 serves to reduce the speed of rotation of travelers 28 relative to the spindles and thereby permits the maintenance of high spindle and bobbin winding speeds while substantially reducing filament breakage or ends down time. The spinning or twisting machine thus far described is representative of the type of machine found in the prior art.

A shaft 34 is journaled in ring rail 22 next to each ring 24. One end of each shaft 34 is attached to an arm 36. The free end of arm 36 carries a spring biased plunger lock 38. The detent 40 of lock 38 is urged by a spring 42 into an indentation 44 formed in ring rail 22. With detent 40 seated in indentation 44, shaft 34 is secured and cannot rotate. A second indentation 46 is formed in ring rail 22 for each shaft 34. Indentations 44 and 46 are located equal radially from the pivot axis of each shaft 34, with indentation 46 being positioned approximately 90 degrees from indentation 44 to enable detent 40 of the plunger lock 38 to be raised, compressing its spring 42, and its associated shaft 34 rotated a quarter of a turn where the detent is released to enter indentation 46, thereby locking the shaft in a second secured position. The opposite end of each shaft 34 is axially offset and carries a wheel 48. Wheel 48 is mounted for rotation to the offset end of shaft 34 by a bearing member 50. Each ring 24 includes a skirt 32. The peripheral face 52 of each wheel 48 is positioned oppositely of a ring skirt 32 with the axis of rotation of the wheel being parallel to the axis of rotation of the ring.

Figure 4:
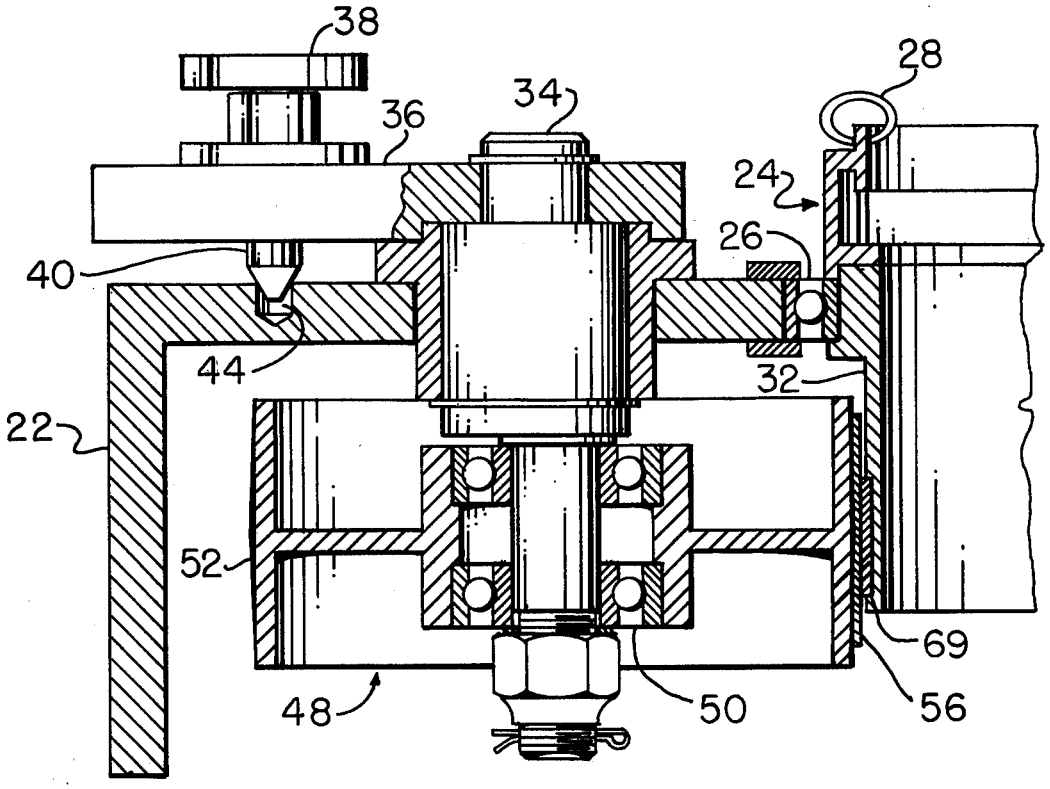
FIG. 4 is a detailed sectional view taken along line 4—4 of FIG. 2.
Figure 5:
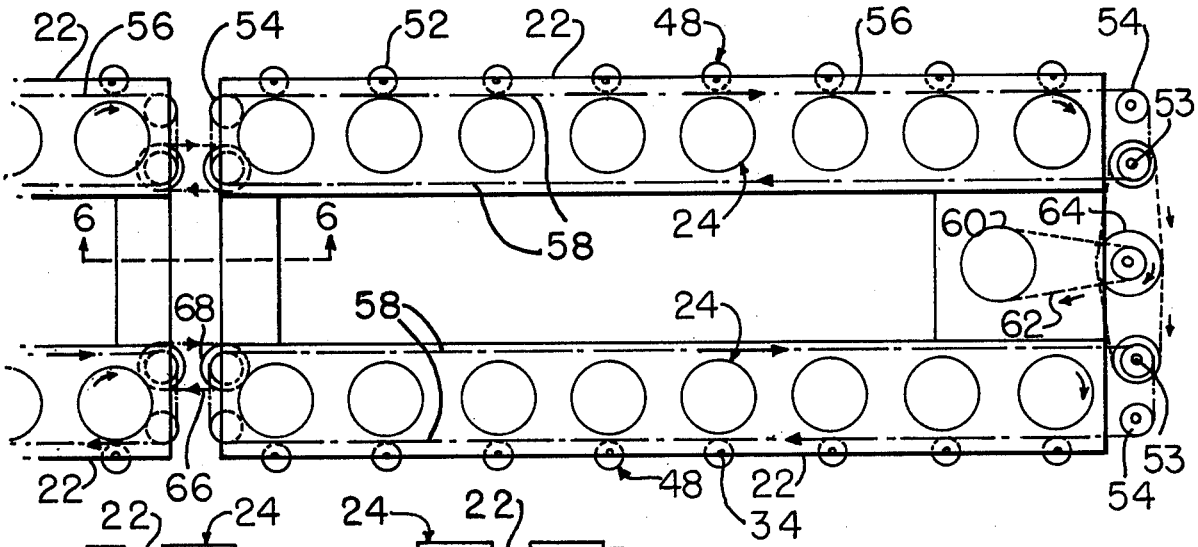
FIG. 5 is a plan view of a plurality of interconnected ring drive modular sections.
Figure 7:
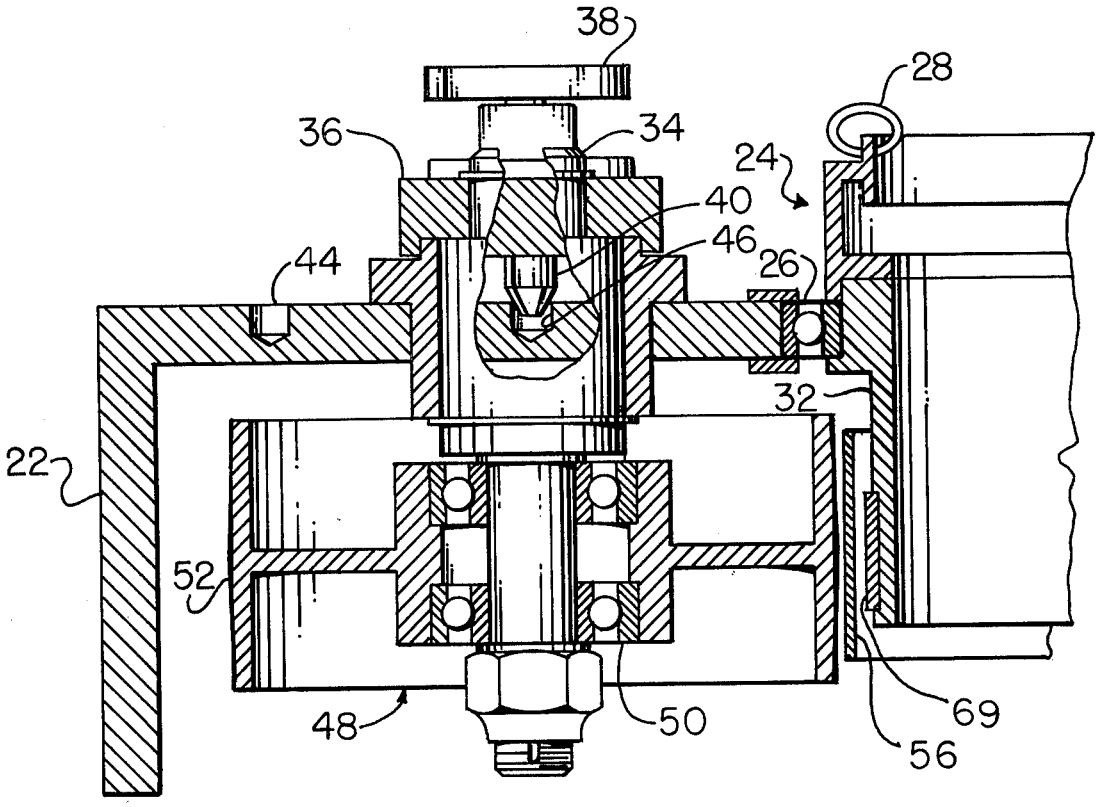
FIG. 7 is a sectional view like FIG. 4 showing the ring drive in its disengaged mode.

As seen in FIGS. 4–5, there is a plurality of longitudinally aligned rings 24 carried by each ring rail 22. For each ring 24 there is a wheel 48 rotatively mounted upon a shaft 34 journaled within the ring rail next to the ring. Each ring rail 22 also carries a pair of pulleys 54 journaled at each of its ends. Pulleys 54 are located at approximately the same level as wheels 48 and ring skirts 32. An endless, substantially non-elastic drive belt 56 having spaced parallel runs 58 passes about pulleys 54 of each ring rail 22. Runs 58 of belt 56 straddle ring skirts 32 with one run 58 extending between each ring 24 and its associated wheel 48, as best seen in FIGS. 4 and 7. A motor 60 is mounted upon machine frame 10 between two ring rails 22 and is connected by a series of toothed drive belts 62 and pulleys 64 by a shaft 53 to one of the pulleys 54 of each rail. Motor 60 causes belts 56 to rotate about pulleys 54 with runs 58 of the belts passing between each wheel 48 and its associated rail skirt 32.

With any arm 36 turned so that its detent 40 is seated within indentation 46 in the ring rail 22, the face 52 of the wheel 48 connected to the arm will be sufficiently spaced from skirt 32 of the adjacent ring 24 that run 58 of belt 56 passes the skirt and also preferably the wheel with clearance, as seen in FIG. 7. When any arm 36 is pivoted so that its detent 40 is seated within ring rail indentation 44, the offset or eccentricity of connected shaft 34 will cause wheel 48 to be shifted toward skirt 32 of the adjacent ring 24 and into contact with belt run 58 which in turn is urged flexibly inwardly into contact with the outer surface 69 of the ring skirt. Ring skirt surface 69 is preferably composed of a machinable grade of elastomeric material in order to create a situation of positive engagement of drive belt 56 with the ring skirt surface. As belt run 58 is forced into contact with ring skirt 32, the ring 24 thereof will be caused to rotate upon its supporting rail 22 about a spindle 14. To stop the rotation of a particular ring 24, wheel 48 associated with that ring need only be shifted away from the ring by pivotal movement of its shaft connected arm 36. This allows run 58 of the belt to flex slightly outwardly into its spaced position from the ring skirt. Face 52 of each wheel 48 is preferably crowned so as to provide a centering guide for contacting belt 56 as it engages a ring 24.

Figure 6:
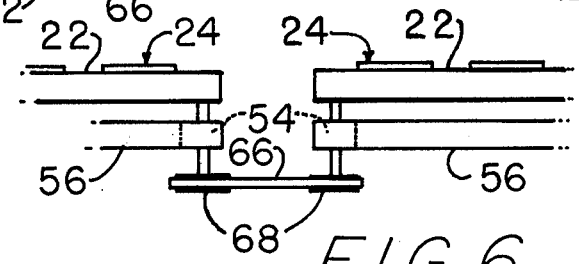
FIG. 6 is a fragmentary elevational view as seen from line 6—6 of FIG. 5.

Each ring rail 22, its rings 24 and associated wheels 48, arms 36, pulleys 54 and belt 56 constitute a modular section which can be removed and replaced as a unit upon frame 10 of the machine by removing and then replacing a minimum number of bolts. Additionally, two or more such modular sections can be frame supported in an end-to-end relationship with their respective drive belts 56 interconnected by a toothed belt 66 trained about toothed pulleys 68 which in turn are shaft-connected to one of the pulleys 54 of each of the modular sections, as shown in FIGS. 5 and 6. A single drive motor 60 serves to provide rotative movement to each of the interconnected drive belts 56 of the modular sections.

Since it is necessary for the rings in a spinning or twisting machine to traverse the full length of the bobbins, it may be necessary in some adaptations of the ring drive of this invention to reverse the orientation of ring skirts 32 and travelers 28 with the skirts and associated wheels 48 being located above the ring rails 22 instead of below the rails as shown. Such a modification would not depart from the spirit of the invention.

It is to be understood that the invention is not to be limited to the details above given but may be modified within the scope of the appended claims.

What I claim is:

1. In a spinning or twisting machine having a spindle carrying a bobbin, means for rotating said spindle, a ring rail, a ring positioned about said bobbin, means mounting said ring to said rail for rotation relative to said bobbin, traveler means carried by said ring for guiding filament material onto said bobbin, the improvement comprising a wheel located adjacently spaced from said ring, a shaft having a pivot axis journaled in said ring rail, said shaft having an offset end portion spaced from said ring rail, said wheel journaled to said shaft offset end portion so as to be laterally shiftable upon rotation of said shaft about its pivot axis, an arm secured at one end to said shaft at a location spaced from said offset end portion, said arm being rotatable about the pivot axis of said shaft to laterally shift said wheel between a first position next to said ring and a second position further spaced from the said ring, lock means cooperable with said rail and carried by said arm spaced from said shaft pivot axis for selectively securing said wheel in either its first or second position, an endless belt having a run passing between said wheel and ring, means for rotating said belt, said belt run being compressed between said wheel and rim in driving contact with the ring to cause rotation of the ring when said wheel is in its first position, said belt run being spaced from said ring when said wheel is in its second position.

2. The machine of claim 1 wherein said belt rotating means operates independently of said spindle rotating means to cause each of said bobbin and ring to be rotated at different selected speeds.

3. In a machine having a plurality of spindles each carrying a bobbin, means for rotating said spindles, a ring rail, a ring associatively positioned about each bobbin, means mounting each ring to said rail for rotation relative to its associated bobbin, traveler means carried by each ring for guiding filament material onto the ring's associated bobbin, the improvement comprising a wheel associated with each ring, a shaft having a pivot axis journaled in said ring rail next to each ring, each shaft having an offset end portion, a said wheel journaled to each shaft offset end portion so as to be laterally shiftable upon rotation of its connected shaft about the shaft's pivot axis, an arm secured at one end to each shaft at a location spaced from said offset end portion of the shaft, each arm being rotatable about the pivot axis of its connected shaft to shift the wheel connected thereto between a first position next to and a second position further spaced from its associated ring, lock means cooperable with said rail and carried by each arm spaced from the privot axis of the shaft connected to the arm for selectively securing the wheel connected thereto in either its first or second positions, an endless belt having a run passing between each wheel and its associated ring, means for rotating said belt, each wheel and associated ring having said belt compressed therebetween when said wheel is in its first position to cause rotation of the ring, said belt run being spaced from each ring when the wheel associated with the ring is in its second position.

4. In a spinning or twisting machine having a plurality of ring rails, a plurality of spindles each carrying a bobbin, means for rotating said spindles, a ring associatively positioned about each bobbin, means mounting each ring to one of said ring rails for rotation relative to its associated bobbin, traveler means carried by each ring for guiding filament material onto the ring's associated bobbin, a plurality of wheels each supported by a ring rail and associated with a ring, each wheel being located adjacently spaced from its associated ring, means mounting each wheel to its supporting ring rail for selected movement between a first position next to and a second position further spaced from its associated ring, each mounting means including a shaft having a pivot axis journaled in said rail adjacent a said ring, each shaft having an offset end portion, each wheel journaled to the offset end portion of a shaft so as to be laterally shiftable upon rotating movement of the shaft about its pivot axis, an arm secured at one end to each shaft at a location spaced from the offset end portion of the shaft, each arm being rotatable about the pivot axis of its connected shaft to shift the wheel journaled thereon between its said first and second positions, lock means cooperable with said rail and carried by each arm spaced from the pivot axis of the arm-connected shaft for selectively securing the wheel journaled thereto in either its frist or second positions, an endless belt carried by each ring rail and having spaced parallel runs, said rings supported by each ring rail being longitudinally spaced and positioned between said belt runs, one belt run passing between each wheel and associated ring, each wheel and associated ring having a belt run compressed therebetween when the wheel is in its first position to cause rotation of the ring and said last mentioned belt run spaced from each ring when the wheel associated therewith is in its second position.

5. The machine of claim 4 wherein each ring rail and associated rings, wheels and belt constitute a removable modular section, at least two of said modular sections positioned end to end, and means for connecting the respective belts of said end to end modular sections together for joint rotation.

6. The machine of claim 5 wherein said belt rotating means constitutes a single motor drive connected to one of the belts of said end-to-end modular sections.

* * * * *